US005248065A

United States Patent [19]

Zima

[11] Patent Number: 5,248,065

[45] Date of Patent: Sep. 28, 1993

[54] TUBE-SQUEEZER

[76] Inventor: John Zima, 25058 Chestnut St., Newhall, Calif. 91321

[21] Appl. No.: 914,710

[22] Filed: Jul. 15, 1992

[51] Int. Cl.[5] ..... B65D 35/28

[52] U.S. Cl. ..... 222/103

[58] Field of Search ..... 222/103, 97, 95

[56] References Cited

U.S. PATENT DOCUMENTS

| | | | |
|---|---|---|---|
| 4,019,656 | 4/1977 | Spears | 222/103 |
| 4,172,536 | 10/1979 | Holt | 222/103 |
| 4,213,543 | 7/1980 | Thiem | 222/103 |
| 4,273,258 | 6/1981 | Stevenson | 222/103 |
| 4,448,330 | 5/1984 | Roux | 222/101 |

FOREIGN PATENT DOCUMENTS

| | | | |
|---|---|---|---|
| 1213343 | 3/1966 | Fed. Rep. of Germany | 222/103 |

*Primary Examiner*—Richard A. Schacher

*Attorney, Agent, or Firm*—Milton S. Gerstein

[57] ABSTRACT

A device for squeezing out the contents of a tube, such as toothpaste. There is provided a flat, lower frame upon which is supported a squeezable tube whose contents are to be dispensed. Extending upwardly from the top, flat surface of the frame are two pairs of two guide-posts. The two pairs of guide-posts are aligned and are spaced apart along the length of the top surface of the frame. The two-guide posts of each pair are laterally spaced apart, whereby a tube may be inserted on the top surface and between the upstanding posts of the pairs of guide-posts. Mounted for manual, vertical movement along the two pairs of guide-posts are a pair of spaced-apart slide-blocks, one such slide-block for one such pair of guide-posts. Each slide-block has a pair of oppositely-disposed through-holes through which pass the two guide-posts of the respective pair. Both slide-blocks are used during the dispensing of the contents of a tube positioned on the top surface of the frame, between the guide-posts. One slide-block is used for squeezing out the contents of the tube through the dispensing mouth, by pressing down on the tube. The other slide-block prevents the contents from being squeezed toward the closed end of the tube as the first slide-block is pushed downwardly to dispense through the open mouth.

16 Claims, 1 Drawing Sheet 12
14
50
56
52
36
30
32
60
10
18
22
40
16
62
36'
42
20
36"

TUBE-SQUEEZER

BACKGROUND OF THE INVENTION

The present invention is directed to a device for squeezing tubes, such as for toothpaste. It is known, that as one continually squeezes a tube for squeezing out its contents, it becomes more difficult to do so, owing to the fact that some of the contents of the tube are squeezed toward the end of the tube away from the dispensing opening. This also causes some of the contents to be wasted, since one does not attempt to squeeze residue of the contents remaining at the end of the tube when much of the tube-contents has been dispensed. Typically, one must roll up the end of the tube over time, as the contents are dispensed, in order to prevent the contents from flowing backward to the closed end of the tube. Prior-art devices exist which are used by placing the tube therein and pivoting down a jaw for forcing out the contents from the tube. However, these do not effectively prevent back-flow to the closed end of the tube, nor do they readily permit the tube to remain therein until the next dispensing.

SUMMARY OF THE INVENTION

It is, therefore, the primary objective of the present invention to provide a device for supporting and squeezing out the contents of tube, whereby the back-flow of the contents toward the closed end of the tube is prevented.

Toward these and other ends, the device of the invention comprises a flat, lower frame upon which is supported a squeezable tube whose contents are to be dispensed. Extending upwardly from the top, flat surface of the frame are two pairs of two guide-posts. The two pairs of guide-posts are aligned and are spaced apart along the length of the top surface of the frame. The two-guide posts of each pair are laterally spaced apart, whereby a tube may be inserted on the top surface and between the upstanding posts of the pairs of guide-posts. Mounted for manual, vertical movement along the two pairs of guide-posts are a pair of spaced-apart slide-blocks, one such slide-block for one such pair of guide-posts. Each slide-block has a pair of oppositely-disposed through-holes through which pass the two guide-posts of the respective pair. Both slide-blocks are used during the dispensing of the contents of a tube positioned on the top surface of the frame, between the guide-posts. One slide-block is used for squeezing out the contents of the tube through the dispensing mouth, by pressing down on the tube. The other slide-block prevents the contents from being squeezed toward the closed end of the tube as the first slide-block is pushed downwardly to dispense through the open mouth.

BRIEF DESCRIPTION OF THE DRAWINGS

The invention will be more readily understood with reference to the accompanying drawing, wherein.

DETAILED DESCRIPTION OF THE INVENTION

Figures 1, 2, 3, 4, 5:
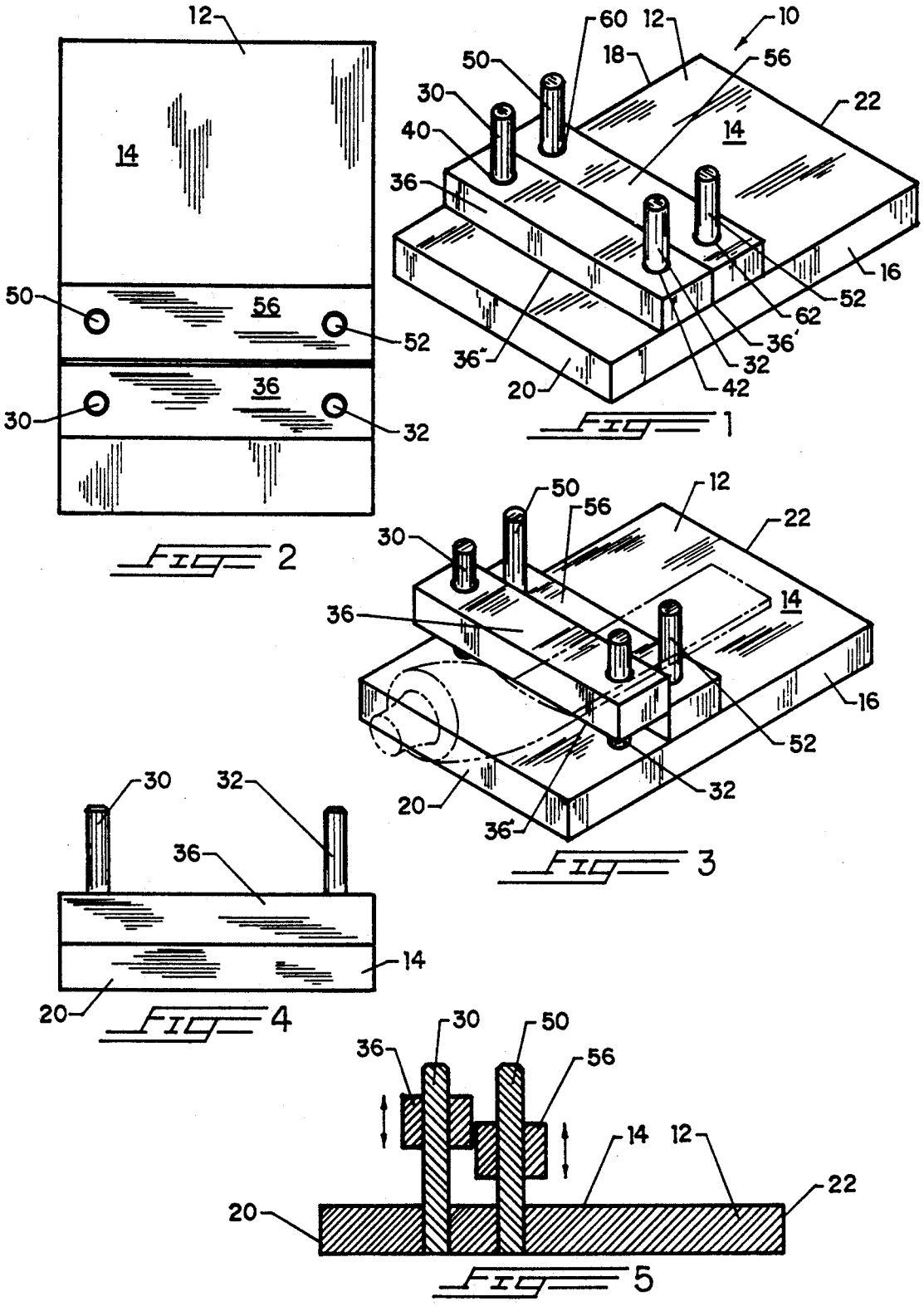
FIG. 1 is a perspective view showing the tube-squeezer of the invention.
FIG. 2 is a top view thereof.
FIG. 3 is a perspective view showing the tube-squeezer of the invention in use for squeezing a tube.
FIG. 4 is an end vierw thereof.
FIG. 5 is a cross-sectional view thereof.

Referring now to the drawing in greater detail, the tube-squeezer of the invention is indicated generally by reference numeral 10. The tube-squeezer 10 has a main, supporting frame 12 defining a top, flat surface 14, vertical side wall-surfaces 16 and 18, front wall-surface 20, and rear wall-surface 22. Provided on the top surface 14 are two pairs of upstanding posts, or dowels. The posts 30, 32 of the first pair are located on opposite lateral sides of the top surface 14, in order to define a space therebetween, in which space is positionable a portion of a tube, such as a toothpaste tube, that is to be squeezed for removing a portion of its contents. Slidably mounted by these two posts 30, 32 is a first, forward, quadrilaterally-shaped slide-block 36, which has a pair of through-holes 40, 42 located on opposite end-portions of the slide-block, which pass therethrough said posts 30, 32, whereby the slide-block 36 is mounted for slidable movement toward and away from the top surface 14.

The second pair of posts 50, 52 is located away from the first pair of posts in a direction toward the rear wall-surface 22. The posts 50, 52 of the second pair are also located on opposite, lateral sides of the top surface 14, to define another space therebetween, in which space is also positionable a portion of the tube, which portion is part of the tube whose contents have already been dispensed after the device 10 has been used a first time for dispensing contents contained in the closed end of the tube. Slidably mounted by these two posts 50, 52 is a second, rearward, quadrilaterally-shaped slide-block 56, which is similar to the first slide-block 36, which has a pair of through-holes 60, 62 located on opposite end-portions of the slide-block, which pass therethrough the posts 50, 52, whereby the slide-block 56 is mounted for slidable movement toward and away from the top surface 14. The second slide-block 56 is spaced from the first slide-block a small distance, or gap. The second slide-block 56 is pressed down before the first slide-block 36, which first slide-block 36 is pressed down for dispensing the contents of the tube, such as toothpaste, for example, through the open mouth of the tube, whereby the first slide-block 36 forces the contents to flow forwardly and out through the open, dispensing mouth of the tube, while the slide-block 56 prevents the contents from flowing backwards toward the closed end of the tube.

In using the device 10, one initially places a full tube such that the end of the closed end of the tube is position at the rear-edge 36'0 of the first slide-block 36, and then presses down on the first slide-block 36 in order to squeeze out some contents through the open dispensing mouth of the tube. The tube remains in that relative position until al of the contents of the tube contained in the portion thereof under the first slide-block 36 have been pushed forwardly along the tube during the dispensing of tube-contents, which may have occurred in just one forced, push-down of the first slide-block 36, or which may have occurred over a relatively long time period with repeated push-downs of the slide-block 36, as in the case of a toothpaste tube. Thereafter, the slide-blocks 36 and 56 are raised, and the tube is moved rearwardly one full width of a slide-block 36, until the portion of the tube whose contents had been pushed forwardly is now positioned under the second slide-block 56 and gap between the two slide-blocks, which gap may be used in some circumstances for visually aiding in the placement of the end-line of the contents of the tube. It is noted that the width of the second slide-block 56 plus the width of the gap between the two slide-blocks 36, 56 may be equal to the width of the first slide-block 56, although, since the gap between the two slide-blocks is so narrow, the two slide-blocks may be made substantially identically, with each having the same width. In this position, the end-line of the contents of the tube which was formed by the front, lower edge 36" of the slide-block 36, lies directly under the rear edge 36' of the first slide-block 36. Thereafter, one first presses down the second slide-block 56 on the empty portion of the tube, in order to prevent backflow, and then the contents of the tube are dispensed again by pressing down on the first slide-block 36 the requisite degree, depending upon the amount to be dispensed. The gap between the two slide-blocks 36, 56 is very small, so that any rearward flow into the portion of the tube positioned thereunder is nonexistent, owing to the presence of the downward pressure created by the pressing of the second slide-block 56. This process is repeated a number of times until all of the contents of the tube have been dispensed. Since no back-flow of tube-contents ever occurs during the tube-dispensing process, all of the tube-contents will have been dispensed, without any residual contents remaining in the tube, as would occur without the use of the device 10.

It is also preferable that the first slide-block 36 be positioned relative to the front wall-surface 20 as seen in FIG. 3, such that the front, dispensing mouth of the tube will be located exteriorly of the front wall-surface 20, so that the dispensing mouth of the tube will project therebeyond, so that a toothbrush, or the like, may be positioned thereunder in order to receive thereon the dispensed contents, even when the last of the contents of the tube are being dispensed.

It is, of course, possible to use the device 10 without having to position the end-line of the tube-contents directly under the rear edge 36'. However, for the most effective use of the device 10, and for the greatest efficiency, it is preferable to so place the end-line thereunder. However, since the rear slide-block 56 is pressed down first, even if the end-line were placed rearwardly of the rear edge 36', in the gap between the two slide-blocks 36, 56, no back-flow would occur, and, in fact, some of the contents would even be forced forwardly owing to the compression caused by the downward pressure of the rear slide-block 56. Thus, owing to the existence and operation of the rear slide-block 56, a great deal of leeway is possible when using the device 10, and still have it perform effectively.

While a specific embodiment of the invention has been shown and described, it is to be understood that numerous changes and modifications may be made therein without departing from the scope, spirit and intent of the invention as set forth in the appended claims.

What I claim is:

1. In a device for use in squeeze-dispensing the contents of a tube, which device comprises a frame member having a top surface upon which the tube to be squeezed is supported, the improvement comprising:

two, spaced-apart pairs of guide-posts extending upwardly from said top surface of said frame-member;

said two pairs of guide-posts being aligned, and each pair comprising two guide-posts, said two guide posts of each said pair being laterally spaced apart, whereby a tube to be dispensed may be inserted on the top surface and between the upstanding posts of said pairs of guide-posts;

a pair of spaced-apart slide-blocks mounted for vertical movement along the two pairs of guide-posts, one said slide-block for one of said pair of guide-posts, and the other said slide-block for the other of said pair of guide-posts; each said slide-block having a pair of oppositely-disposed through-holes through which pass two said guide-posts of a respective said pair of guide-posts;

said one slide-block being spaced from said other slide-block along the length of said top surface to define a narrow gap therebetween in order to allow for the independent movement of each said slide-block, whereby both said slide-blocks are used during the dispensing of the contents of a tube positioned on said top surface of said frame-member, one slide-block being used for squeezing out the contents of the tube through the dispensing mouth thereof by pressing down on the tube therewith, and the other slide-block preventing the contents from being squeezed toward the closed end of the tube as the first slide-block is pushed downwardly to dispense through the mouth.

2. The device according to claim 1, wherein each of said slide-blocks is quadrilaterally-shaped; said first slide-block having a lower, forward edge that forms the end-line of tube-contents.

3. The device according to claim 2, wherein the width of said first slide-block is equal to the width of said second slide-block.

4. The device according to claim 1, wherein the width of said first slide-block is equal to the width of said second slide-block plus the width of said gap.

5. The device according to claim 1, further comprising a toothpaste tube supported on said top surface; said tube having a first portion positioned under, and in contact with, said first slide-block, a second portion positioned under said gap, and a third portion positioned under, and in contact with, said second slide-block.

6. The device according to claim 5, wherein said first slide-block is positioned relatively closer to the front wall-surface of said frame such that the front, dispensing mouth of said tube is located exteriorly of the front wall-surface, so that the dispensing mouth of said tube will project therebeyond, so that a toothbrush may be positioned thereunder in order to receive thereon the dispensed contents when the last of the contents of said tube are being dispensed.

7. A method of using a device for use in squeeze-dispensing the contents of a tube, which device comprises a frame member having a top surface upon which the tube to be squeezed is supported, two, spaced-apart pairs of guide-posts extending upwardly from said top surface of said frame-member; said two pairs of guide-posts being aligned, and each pair comprising two guide-posts, said two guide posts of each pair being laterally spaced apart, whereby a tube to be dispensed may be inserted on the top surface and between the upstanding posts of said pairs of guide-posts; a pair of independently movable slide-blocks mounted for vertical movement along the two pairs of guide-posts, one said slide-block for one of said pair of guide-posts, and the other said slide-block for the other of said pair of guide-posts; each said slide-block having a pair of oppositely-disposed through-holes through which pass two said guide-posts of a respective said pair of guide-posts; said one slide-block being spaced from said other slide-block along the length of said top surface to define a space therebetween, whereby both said slide-blocks are used during the dispensing of the contents of a tube positioned on said top surface of said frame-member, one slide-block being used for squeezing out the contents of the tube through the dispensing mouth thereof by pressing down on the tube therewith, and the other slide-block preventing the contents from being squeezed toward the closed end of the tube as the first slide-block is pushed downwardly to dispense through the mouth, said method comprising:

(a) raising said slide-blocks along respective said guide-posts;

(b) inserting a tube to be squeezed on said top surface between said two pair of guide-posts, and below said two raised slide-blocks;

(c) pushing down on said one slide-block to squeeze out the contents of the tube;

(d) prior to said step (b), pushing down on said other slide block in order to prevent the contents from flowing backward toward the closed end of the tube when said step (c) is performed.

8. The method according to claim 7, further comprising:

(e) said step (b) comprising placing the tube on said top surface such that the first end-line defining where the contents of the tube terminate is located under said space between two slide-blocks;

(f) raising said slide-blocks a second time, and removing the tube thereunder;

(g) repeating said steps (b) through (e) a second time for a different second end-line defining where the contents of the tube terminate.

9. The method according to claim 8, wherein said step (b) of said step (g) comprises moving the tube a distance equal the width of said one slide-block, said distance being equal to the distance between said first and second end-lines.

10. The method according to claim 8, wherein said step (e) comprises visually inspecting through said space between said slide-blocks the positioning of said first end-line.

11. The method according to claim 9, wherein said step (e) of said step (g) comprises visually inspecting through said space between said slide-blocks the positioning of said second end-line.

12. The method according to claim 11, wherein said step (b) of said step (g) comprises moving the tube a distance equal the width of said one slide-block, said distance being equal to the distance between said first and second end-lines.

13. The method according to claim 7, wherein each of said steps (a) through (d comprises manually performing the respective said step.

14. The method according to claim 8, wherein each of said steps (a) through (g) comprises manually performing the respective said step.

15. The method according to claim 7, wherein said step (b) comprises positioning the dispensing mouth of the tube past the front wall-surface of the frame-member.

16. The method according to claim 8, wherein each said step (b) performed comprises positioning the dispensing mouth of the tube past the front wall-surface of the frame-member, said first slide-block being located relatively closer to the front wall of the frame-member for allowing said step of positioning to be carried out.

* * * * *